United States Patent [19]

Chaussadas

[11] Patent Number: 5,031,770

[45] Date of Patent: Jul. 16, 1991

[54] PACKAGE WITH FOLDABLE SEPARATOR TABS FOR SPACING ROWS OF ARTICLES

[75] Inventor: Jean Chaussadas, Deols, France

[73] Assignee: The Mead Corporation, Dayton, Ohio

[21] Appl. No.: 609,870

[22] Filed: Nov. 7, 1990

Related U.S. Application Data

[63] Continuation of Ser. No. 494,334, Mar. 16, 1990, abandoned.

[30] Foreign Application Priority Data

Mar. 17, 1989 [GB] United Kingdom ..... 8906222

[51] Int. Cl.[5] ..... B65D 75/04

[52] U.S. Cl. ..... 206/434; 206/140; 229/40

[58] Field of Search ..... 206/140, 158, 160, 427, 206/430, 434; 229/40

[56] References Cited

U.S. PATENT DOCUMENTS

| | | | |
|---|---|---|---|
| 3,381,881 | 5/1968 | Ganz et al. | 229/40 |
| 3,747,835 | 7/1973 | Graser | 229/40 |
| 4,526,316 | 7/1985 | Sutherland | 229/40 |
| 4,703,847 | 11/1987 | Oliff | 229/40 |
| 4,756,419 | 7/1988 | Le Bras | 229/40 |

FOREIGN PATENT DOCUMENTS

| | | |
|---|---|---|
| 1073166 | 6/1967 | United Kingdom . |
| 1115638 | 5/1968 | United Kingdom . |
| 1140333 | 1/1969 | United Kingdom . |
| 1221320 | 3/1971 | United Kingdom . |
| 2207903 | 2/1989 | United Kingdom . |

*Primary Examiner*—Jimmy G. Foster
*Attorney, Agent, or Firm*—Erwin Doerr

[57] ABSTRACT

A package accommodating a plurality of articles (c) arranged in two or more rows (R1, R2) and in at least one tier (T1, T2) comprises a top panel (18) and a pair of overlapped base panels (12, 24) forming a carton base which is spaced apart from the top panel by a pair of side wall panels thereby forming a tubular structure. One of the base panels (24) has a row of erected tabs (t) forming an interrupted separating keel between lower portions of one row of articles seated on the carton base and lower portions of an adjacent row of articles seated on the carton base. Each of the erected tabs has opposite wing portions (50, 52) which are supported against collapse by the outermost base panel (12) to maintain the tab in an erected position.

4 Claims, 2 Drawing Sheets

PACKAGE WITH FOLDABLE SEPARATOR TABS FOR SPACING ROWS OF ARTICLES

This application is a continuation of application Ser. No. 07/494,334, filed Mar. 16, 1990, now abandoned.

This invention relates to a package of the wrap-around type which includes foldable separator tabs for spacing apart base portions of one row of articles from those in an adjacent row.

The package is particularly suitable for packaging two or more rows of containers of the type having top flanges and which are connected to similar containers by their top flanges to form a group of e.g. eight containers. More particularly, the package is suitable for accommodating two tiers of container groups e.g. eight containers in a lower group and a further eight containers in an upper group.

Since such containers are connected only by their top flanges there is a tendency for their bases to swing relative to one another about their flanged connection. When such containers are packaged in two or more rows this freedom of movement at their bases causes distortion of the package, particularly a wrap-around package, which may lead to dislodgement of the containers.

The present invention seeks to overcome this disadvantage by maintaining the base portions of one row of such containers spaced from the base portions of an adjacent row of such containers.

The invention provides a package accommodating a plurality of articles arranged in two or more rows and in at least one tier which package comprises a top panel and a pair of overlapped base panels forming a carton base which is spaced apart by a pair of side wall panels thereby forming a tubular structure, one of said base panels having a plurality of erected tabs folded out of the plane of that panel and forming an interrupted separating keel between lower portions of one row of articles seated on the carton base and lower portions of an adjacent row of articles seated on the carton base, each of said erected tabs including a central portion hinged at one peripheral edge of an aperture in the said one base panel from which the tab is struck and opposite wing portions hinged to said central portion which are supported by the other of said pair of base panels adjacent the periphery of said aperture to maintain the tab in an erected position and in that movement of said opposite wing portions of the tabs away from one another is minimised by said lower portions of adjacent rows of articles.

An embodiment of the invention will now be described, by way of example, with reference to the accompanying drawings, in which.

Figure 1:
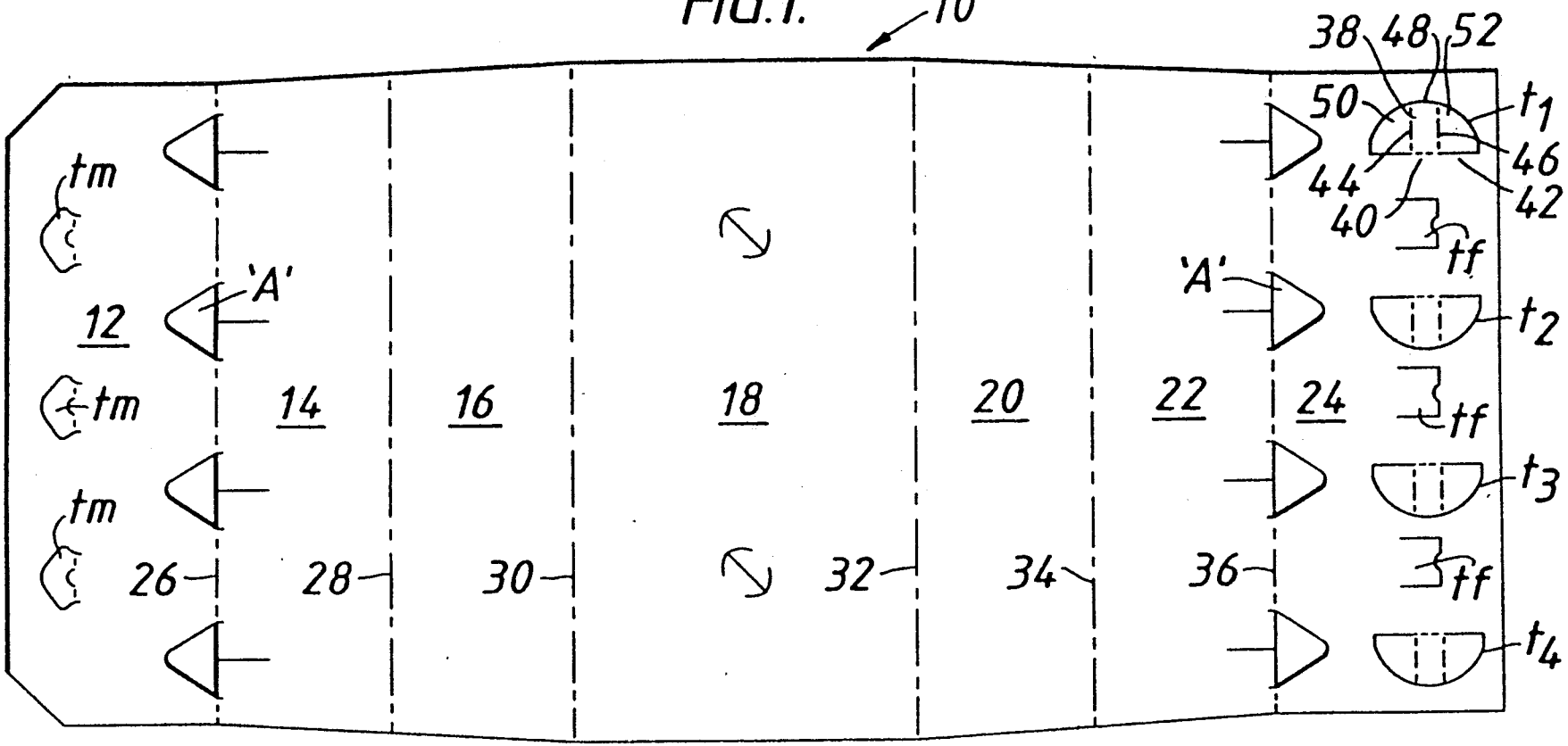
FIG. 1 is a plan view of a blank from which a carton according to the invention is formed.

Referring to the drawings, the flat elongate blank 10 shown in FIG. 1 is formed from paperboard or similar foldable sheet material and comprises, in series, a first base panel 12, a first side wall panel comprising first lower side wall panel 14 and first upper side wall panel 16, a top panel 18, a second side wall comprising a second upper side wall panel 20 and a second lower side wall panel 22 and a second base panel 24 hinged one to the next along transverse fold lines 26, 28, 30, 32, 34 and 36, respectively.

The fold line junction 26 and 36 between base panel 12 and lower side wall panel 14 and base panel 24 and lower side wall panel 22 are each formed with a series of article heel retaining apertures 'A' which interrupt the respective fold lines 26 and 36. These apertures receive peripheral wall portions at the bases of the containers in the lower tier group to be packaged and assist in the retention of the articles, as is well known in the multiple packaging art.

The base panel 24 is formed with a central row of foldable keel tabs 't1–t4' which are all of similar construction and for the sake of brevity keel tab t1 only is now described in more detail. Keel tab t1 comprises a segmental portion struck from the base panel 24 such that a central part 38 of the keel tab is hinged along fold line 40 to a chordal edge 42 of the aperture, which the keel tab t1 defines. The central part 38 of the keel tab is, in part, defined by a pair of parallel fold lines 44 and 46 extending perpendicularly from the opposite extremities of fold line 40 to the arcuate edge 48 of the aperture. Fold lines 44 and 46 each provide the hinged connection by which opposite wings 50 and 52 respectively, are foldably joined to the central part 38 of keel tab t1. Female retaining tabs tf which define locking apertures in base panel 24 are provided between successive keel tabs and a row of male locking tabs tm for cooperation with the locking apertures is provided adjacent the free edge of base panel 12.

Figure 2:
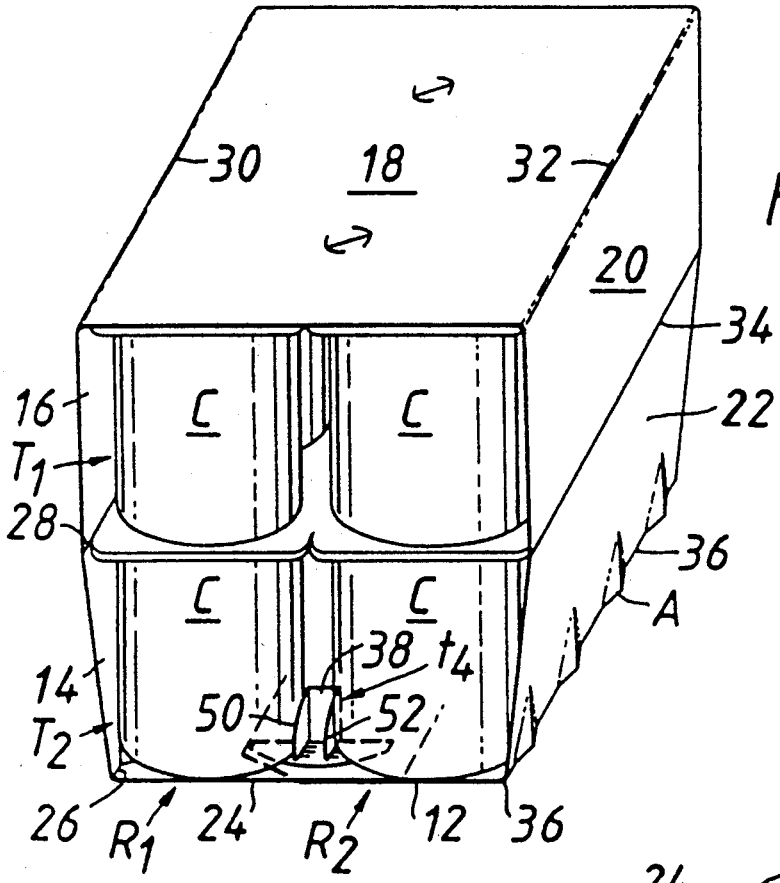
FIG. 2 is a perspective view of a carton formed from the blank shown in FIG. 1, as seen from one end and comprising a double tier of containers.

Tab t1 may be manipulated from the flat collapsed position shown in FIG. 1 to an erected condition as best shown in FIG. 2 so as to provide a component of an interrupted keel separator for the carton, comprising all the erected tabs t, and this is effected during application of the carton blank to the two tier group of containers 'c'. To this end, the blank is applied to the container group in known manner so that the top panel 18 overlies the tops of the group of containers in the upper tier T1 and the side walls then folded downwardly so that they are disposed adjacent the side walls of the containers in both the upper tier T1 and the lower tier T2. Thereafter, base panel 24 is folded upwards so that the female retaining tabs tf and the keel tabs are aligned with the central space extending between the two rows of R1 and R2 of the lower tier T2 of containers.

Each of the keel tabs is then displaced upwardly, either simultaneously or in quick succession, out of the plane of the base panel 24 by suitable machine elements. In so doing, the opposite wings 50, 52 extend into the interior of the carton and strike the bases of a pair of adjacent containers in rows R1, R2 of the lower tier T2. The wings thereby are folded about their respective fold lines 44 and 46 during upward movement of the keel tab by virtue of the engagement between the keel tab and the adjacent container side walls so that the wings are directed towards one or other end of the carton (FIG. 2). This folding of the wings causes them to extend in a direction across the apertures in the base panel 24 from which the keel tabs are struck and because the wing portions of the keel tabs are shorter than or equal in length to the width, i.e. the length of fold lines 44 and 46, of its associated aperture it is necessary to support the wing portions against collapsing into or through the associated aperture and this function is achieved by the base panel 26. The blank is secured in position around the container groups by driving the male locking tabs tm through the apertures defined by the female retaining tabs tf as is well known in the art.

To this end, the other base panel 12 is brought into overlapping relationship with base panel 24 and the male locking tabs are interlocked with the female retaining tabs in a manner well known in the art during which the retaining apertures A engage peripheral wall portions of the containers in the lower tier T2. Thus, base panel 12 covers the apertures from which the keel tabs are struck so that the keel tabs are supported by base panel 12 and cannot collapse by passing back into or through their respective apertures.

Figure 3:
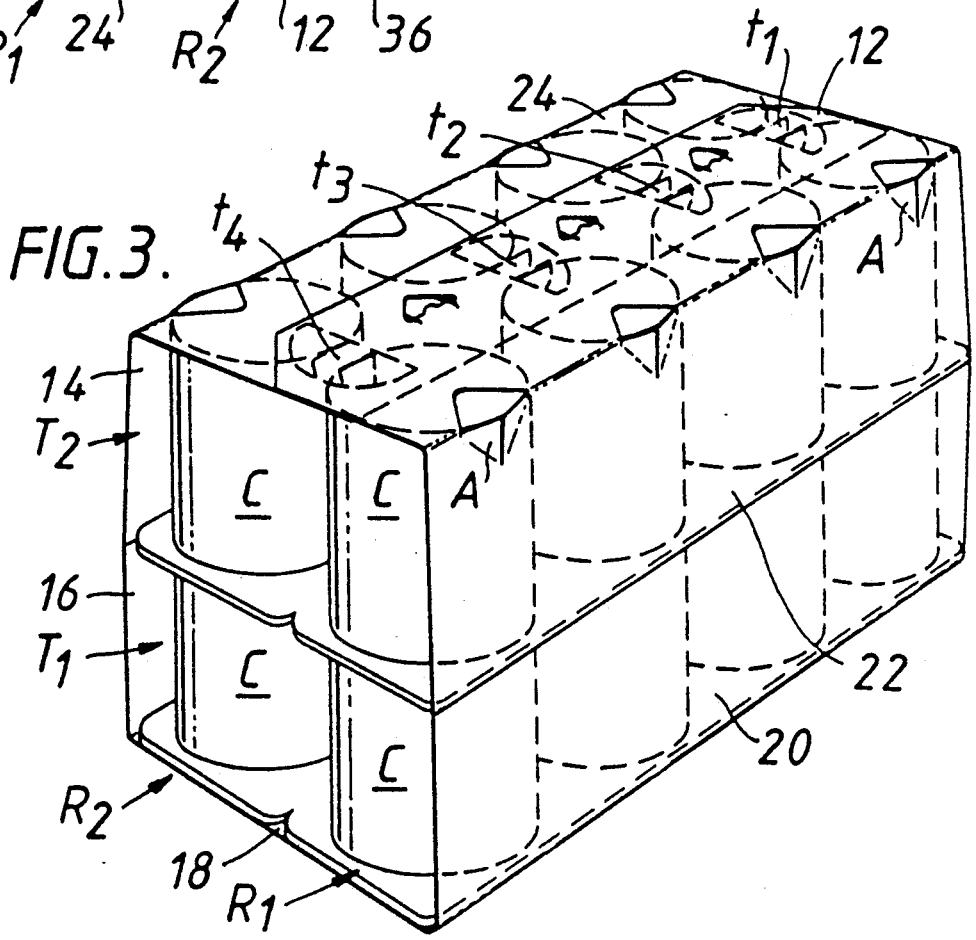
FIG. 3 is a perspective view of the carton formed from the blank shown in FIG. 1, as seen from below and to one side.

The blank 10 illustrated in FIG. 1 is fabricated so as to form a package of tiers each of which has two rows R1 and R2 of uniform articles 'c' with four articles in each row as shown in FIGS. 2 and 3. However, it is envisaged that a modified blank may form a carton with a single tier and/or a different number of articles in each row, e.g. two articles per row.

I claim:

1. A package accomodating a plurality of articles having outwardly projecting flanges at the tops thereof and arranged in two or more rows so that the lower portions of the articles in adjacent rows are spaced apart from each other, the package including a carton comprising a top panel and base panel means spaced from said top panel by a pair of side wall panels thereby forming a tubular structure, said base panel means having a plurality of keel tabs folded out of the plane thereof and forming an interrupted separating keel between the lower portions of the articles in adjacent rows, each of said keel tabs being formed from material struck from said base panel means in the form of an aperture and including a central portion joined to said aperture along a hinge line, and opposing wing portions hinged to said central portion along fold lines arranged in angular relationship to said hinge line, said central portion being folded upwardly to extend into the interior of the carton and said wing portions being folded to extend longitudinally between the lower portions of said articles in said adjacent rows, characterized in that said base panel means comprises overlapping outer and inner base panels and said keel tabs are struck from said inner base panel and said outer base panel covers at least partially said aperture formed in the inner base panel by removing said keel tabs therefrom.

2. The package according to claim 1, further characterized in that said aperture is in the form of a segment and said central portion of said keel tab is hinged to said aperture along a portion of the chordal edge of said aperture.

3. The package according to claim 2, further characterized in that said central portion of said keel tab extends from said chordal edge to the opposite arcuate edge of said aperture.

4. The package according to claim 2, further characterized in that said aperture is substantially semi-circular.

* * * * *